US006861274B2

(12) United States Patent
List et al.

(10) Patent No.: US 6,861,274 B2
(45) Date of Patent: Mar. 1, 2005

(54) METHOD OF MAKING A SDI ELECTROOSMOTIC PUMP USING NANOPOROUS DIELECTRIC FRIT

(75) Inventors: R. Scott List, Beaverton, OR (US); Alan Myers, Portland, OR (US); Quat T. Vu, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/402,435

(22) Filed: Mar. 28, 2003

(65) Prior Publication Data

US 2004/0191943 A1 Sep. 30, 2004

(51) Int. Cl.[7] ..... H01L 21/00

(52) U.S. Cl. ..... 438/42; 438/14; 438/424

(58) Field of Search ..... 438/14, 15, 17, 438/101, 106, 107, 110, 127, 406, 409, 424, 453, 454, 466, 42, 597, 598, 669, 674, 680, 692, 697, 959, 778; 4381/778

(56) References Cited

U.S. PATENT DOCUMENTS 6,055,003 A * 4/2000 Hawkins et al. ..... 346/140.1
6,136,212 A * 10/2000 Mastrangelo et al. ..... 216/49
6,156,651 A * 12/2000 Havemann ..... 438/674
6,351,274 B1 * 2/2002 Hawkins et al. ..... 346/140.1
6,379,870 B1 * 4/2002 Dunne ..... 430/314
6,407,006 B1 * 6/2002 Levert et al. ..... 438/761
6,455,130 B1 * 9/2002 Wallace et al. ..... 428/163
6,576,896 B2 * 6/2003 Figeys et al. ..... 250/288
6,605,454 B2 * 8/2003 Barenburg et al. ..... 435/173.7
6,639,712 B2 * 10/2003 McBride et al. ..... 359/298
6,670,022 B1 * 12/2003 Wallace et al. ..... 428/156
6,719,535 B2 * 4/2004 Rakestraw et al. ..... 417/50
2002/0158322 A1 10/2002 Farrar
2003/0003619 A1 * 1/2003 Winer et al. ..... 438/50
2003/0038027 A1 2/2003 Schoeniger et al.
2003/0062149 A1 * 4/2003 Goodson et al. ..... 165/104.11
2004/0101421 A1 * 5/2004 Kenny et al. ..... 417/313
2004/0118689 A1 * 6/2004 Crocker et al. ..... 204/600

FOREIGN PATENT DOCUMENTS

WO WO 00/55502 9/2000

OTHER PUBLICATIONS

S. Mutlu et al., *Micromachined Porous Polymer For Bubble Free Electro–Osmotic Pump*, Proc. IEEE MEMS 2002, Las Vegas, USA, Jan. 20, 2002, pp. 19–23.

D. Laser et al., *Silicon Electroosmotic Micropumps For Integrated Circuit Thermal Management*, IEEE Transducers 2003, Boston, USA, Jun. 8, 2003, pp. 151–154.

D. Laser et al., *A Micromachined Silicon Low–Voltage Parallel–Plate Electrokinetic Pump*, Transducers 2001, Munich, Germany, Jun. 10, 2001, pp. 920–923.

Miller et al., "Nanoporous, Low Dielectric Constant Organosilicate Materials Derived from Inorganic/Organic Polymer Blends", IBM Almaden Research Center, San Jose, California, Jun. 6–7, 2002.

* cited by examiner

*Primary Examiner*—John F. Niebling
*Assistant Examiner*—Stanetta Isaac
(74) *Attorney, Agent, or Firm*—Trop, Pruner & Hu, P.C.

(57) ABSTRACT

An electroosmotic pump may be fabricated using semiconductor processing techniques with a nanoporous open cell dielectric frit. Such a frit may result in an electroosmotic pump with better pumping capabilities.

5 Claims, 3 Drawing Sheets

METHOD OF MAKING A SDI ELECTROOSMOTIC PUMP USING NANOPOROUS DIELECTRIC FRIT

BACKGROUND

This invention relates generally to electroosmotic pumps and, particularly, to such pumps fabricated in silicon using semiconductor fabrication techniques.

Electroosmotic pumps use electric fields to pump a fluid. In one application, they may be fabricated using semiconductor fabrication techniques. They then may be applied to the cooling of integrated circuits, such as microprocessors.

For example, an integrated circuit electroosmotic pump may be operated as a separate unit to cool an integrated circuit. Alternatively, the electroosmotic pump may be formed integrally with the integrated circuit to be cooled. Because the electroosmotic pumps, fabricated in silicon, have an extremely small form factor, they may be effective at cooling relatively small devices, such as semiconductor integrated circuits.

Thus, there is a need for better ways to form electroosmotic pumps using semiconductor fabrication techniques.

DETAILED DESCRIPTION

Figure 1:
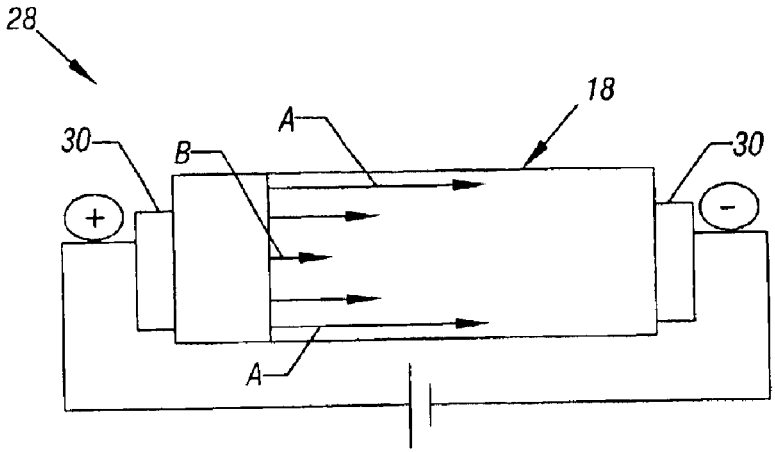
FIG. 1 is a schematic depiction of the operation of the embodiment in accordance with one embodiment of the present invention.

Referring to FIG. 1, an electroosmotic pump 28 fabricated in silicon is capable of pumping a fluid, such as a cooling fluid, through a frit 18. The frit 18 may be coupled on opposed ends to electrodes 30 that generate an electric field that results in the transport of a liquid through the frit 18. This process is known as the Electroosmotic effect. The liquid may be, for example, water and the frit may be composed of silicon dioxide in one embodiment. In this case hydrogen from hydroxyl groups on the wall of the frit deprotonate resulting in an excess of hydrogen ions along the wall, indicated by the arrows A. The hydrogen ions move in response to the electric field applied by the electrodes 30. The non-charged water atoms also move in response to the applied electric field because of drag forces that exist between the ions and the water atoms.

As a result, a pumping effect may be achieved without any moving parts. In addition, the structure may be fabricated in silicon at extremely small sizes making such devices applicable as pumps for cooling integrated circuits.

In accordance with one embodiment of the present invention, the frit 18 may be made of an open and connected cell dielectric thin film having open nanopores. By the term "nanopores," it is intended to refer to films having pores on the order of 10 to 100 nanometers. In one embodiment, the open cell porosity may be introduced using the sol-gel process. In this embodiment, the open cell porosity may be introduced by burning out the porogen phase. However, any process that forms a dielectric film having interconnected or open pores on the order of 10 to 100 nanometers may be suitable in some embodiments of the present invention.

For example, suitable materials may be formed of organosilicate resins, chemically induced phase separation, and sol-gels, to mention a few examples. Commercially available sources of such products are available from a large number of manufacturers who provide those films for extremely low dielectric constant dielectric film semiconductor applications.

In one embodiment, an open cell xerogel can be fabricated with 20 nanometer open pore geometries that increase maximum pumping pressure by a few orders of magnitude. The xerogel may be formed with a less polar solvent such as ethanol to avoid any issues of water tension attacking the xerogel. Also, the pump may be primed with a gradual mix of hexamethyldisilazane (HMDS), ethanol and water to reduce the surface tension forces. Once the pump is in operation with water, there may be no net forces on the pump sidewalls due to surface tension.

Referring to FIGS. 2–9, the fabrication of an electroosmotic pump 28 using a nanoporous open cell dielectric frit 18 begins by patterning and etching to define an electroosmotic trench.

Figure 2:
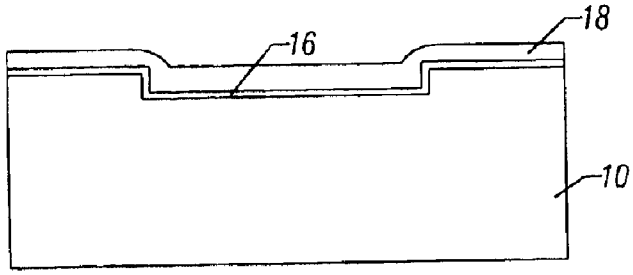
FIG. 2 is an enlarged cross-sectional view of one embodiment of the present invention at an early stage of manufacture.

Referring to FIG. 2, a thin dielectric layer 16 may be grown over the trench in one embodiment. Alternatively, a thin etch or polish-stop layer 16, such as a silicon nitride, may be formed by chemical vapor deposition. Other techniques may also be used to form the thin dielectric layer 16. The nanoporous dielectric layer 18 may than be formed, for example, by spin-on deposition. In one embodiment, the dielectric layer 18 may be in the form of a sol-gel. The deposited dielectric layer 18 may be allowed to cure.

Figure 3:
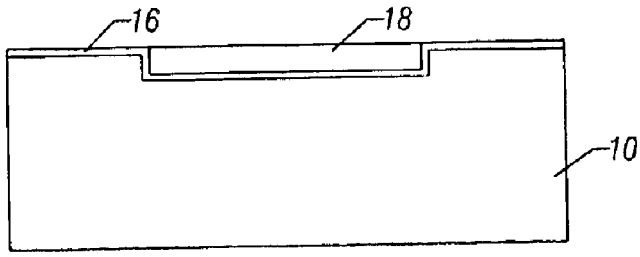
FIG. 3 is an enlarged cross-sectional view at a subsequent stage of manufacture in accordance with one embodiment of the present invention.

Then, referring to FIG. 3, the structure of FIG. 2 may be polished or etched back to the stop layer 16. As a result, a nanoporous dielectric frit 18 may be defined within the layer 16, filling the substrate trench.

Figure 4:
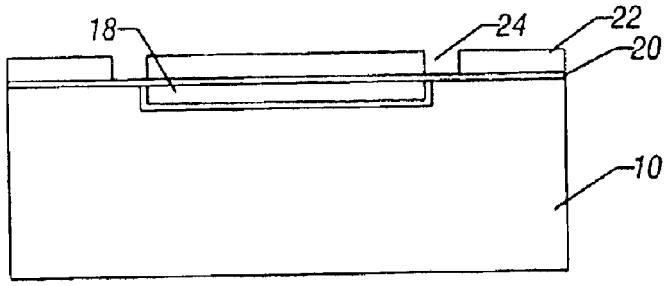
FIG. 4 is an enlarged cross-sectional view at a subsequent stage of manufacture in accordance with one embodiment of the present invention.

Referring next to FIG. 4, openings 24 may be defined in a resist layer 22 in one embodiment of the present invention. The openings 24 may be effective to enable electrical connections to be formed to the ends of the frit 18. Thus, the openings 24 may be formed down to a deposited oxide layer 20 that may encapsulate the underlying frit 18. In some embodiments, the deposited oxide layer 20 may not be needed.

Figure 5:
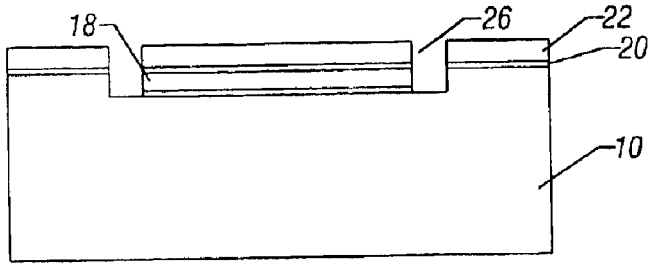
FIG. 5 is an enlarged cross-sectional view at a subsequent stage of manufacture in accordance with one embodiment of the present invention.
Figure 6:
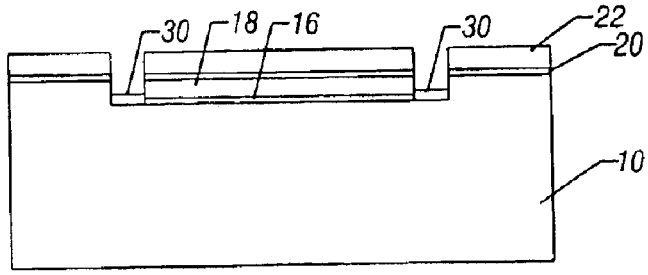
FIG. 6 is an enlarged cross-sectional view at a subsequent stage of manufacture in accordance with one embodiment of the present invention.

The resist 22 is patterned as shown in FIG. 4, the exposed areas are etched and then used as a mask to form the trenches 26 alongside the nanoporous dielectric layer 18 as shown in FIG. 5. Once the trenches 26 have been formed, a metal 30 may be deposited on top of the wafer In one emobodiment, sputtering can be used to deposit the metal. The metal can be removed by etching of lift-of techniques in such a manner as to leave metal only in the trench at the bottom of the trenches 26 as shown in FIG. 6. The metal 30 is advantageously made as thin as possible to avoid occluding liquid access to the exposed edge regions of the frit 18, which will ultimately act as the entrance and exit openings to the pump 28.

Figure 7:
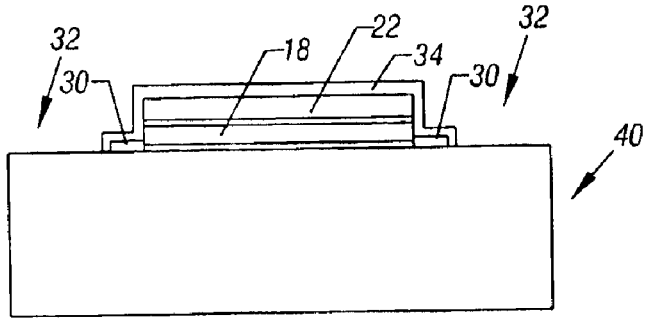
FIG. 7 is an enlarged cross-sectional view taken along the lines 7—7 in FIG. 8 at a subsequent stage of manufacture in accordance with one embodiment of the present invention.
Figure 8:
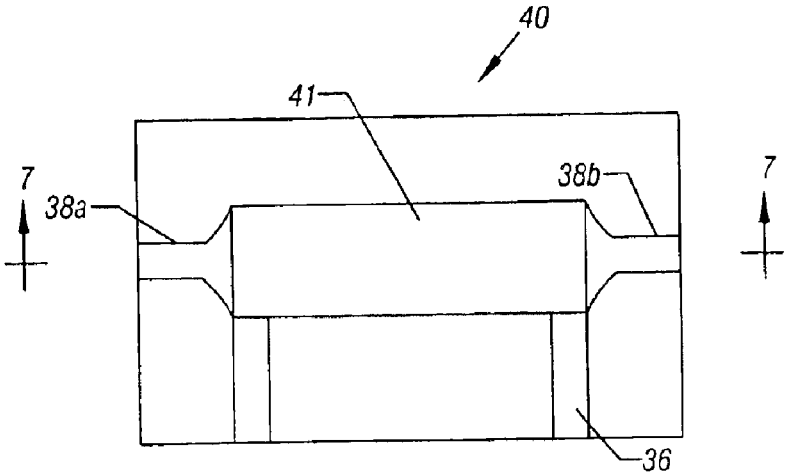
FIG. 8 is a top plan view of the embodiment shown in FIG. 8 in accordance with one embodiment of the present invention.

Referring to FIG. 7, a chemical vapor deposition material 34 may be formed over the frit 18 and may be patterned with photoresist and etched, as indicated at 32, to provide for the formation of microchannels 38 shown in FIG. 8. The microchannels 38 act as conduits to convey liquid to and from the rest of the pump 41. Also, electrical interconnections 36 may be fabricated by depositing metal (for example by sputtering), and removing the metal in selected areas (for example by lithographic patterning and etching across the wafer to enable electrical current to be supplied to the contacts 30. This current sets up an electric field that is used to draw the fluid through the pump 28.

Figure 9:
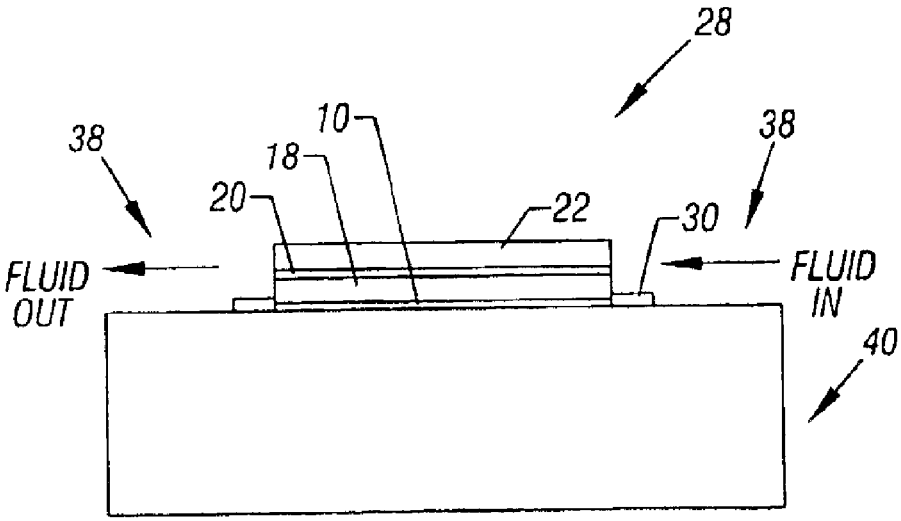
FIG. 9 is an enlarged cross-sectional view of a completed structure in accordance with one embodiment of the present invention.

Referring to FIG. 9, the fluid may pass through the microchannels 38 and enter the frit 18 by passing over the first contact 30. The fluid is drawn through the frit 18 by the electric field and the disassociation process described previously. As a result, the fluid, which may be water, is pumped through the pump 28.

Figure 10:
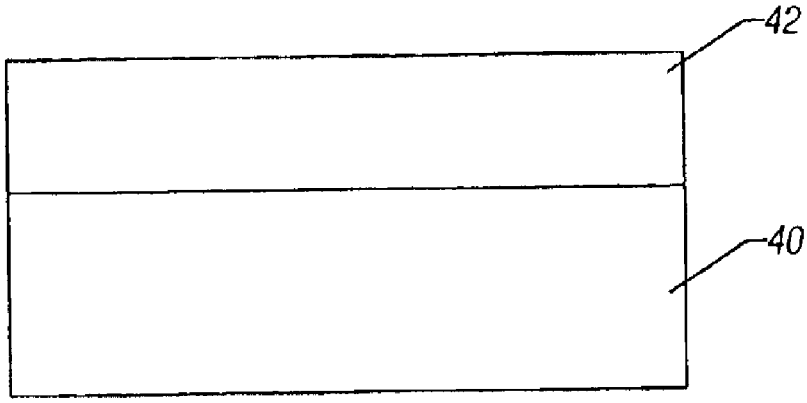
FIG. 10 is an enlarged cross-sectional view of one embodiment of the present invention.

Referring to FIG. 10, the substrate 10 may be separated into dice and each die 40 may be secured to a die 42 to be cooled, in one embodiment of the present invention. For example, the dice 40 and 42 may be interconnected by silicon dioxide bonding techniques, as one example. Alternatively, the pump 28 may be formed directly in the die 42 to be cooled in the wafer stage, for example, on its backside.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

forming a trench in a semiconductor wafer;

forming a nanoporous open cell dielectric in said trench; and using the dielectric as a frit to form an electroosmotic pump.

2. The method of claim 1 including forming a dielectric layer in said trench before filling the trench with the nanoporous open cell dielectric.

3. The method of claim 1 wherein forming the trench with a nanoporous open cell dielectric includes filling the trench with a sol-gel.

4. The method of claim 3 including allowing the sol-gel to cure.

5. The method of claim 1 including separating said wafer into dice and securing at least one of said dice to an integrated circuit to be cooled.

* * * * *